US009637805B2

(12) United States Patent
Dorner et al.

(10) Patent No.: US 9,637,805 B2
(45) Date of Patent: May 2, 2017

(54) NON-GRAIN-ORIENTED ELECTRICAL STEEL STRIP OR SHEET, COMPONENT MANUFACTURED FROM IT AND METHOD FOR PRODUCING A NON-GRAIN-ORIENTED ELECTRICAL STEEL STRIP OR SHEET

(71) Applicant: ThyssenKrupp Steel Europe AG, Duisburg (DE)

(72) Inventors: Dorothee Dorner, Dusseldorf (DE); Olaf Fischer, Bochum (DE); Karl Telger, Coesfeld (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 14/118,720

(22) PCT Filed: Dec. 18, 2012

(86) PCT No.: PCT/EP2012/075966

§ 371 (c)(1),
(2) Date: Nov. 19, 2013

(87) PCT Pub. No.: WO2013/102556

PCT Pub. Date: Jul. 11, 2013

(65) Prior Publication Data

US 2014/0083573 A1 Mar. 27, 2014

(30) Foreign Application Priority Data

Jan. 5, 2012 (EP) ..... 12150315

(51) Int. Cl.

| | |
|---|---|
| ***C21D 8/02*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***H01F 1/16*** | (2006.01) |
| *H01F 1/147* | (2006.01) |

(52) U.S. Cl.

CPC ..... *C21D 8/0273* (2013.01); *C21D 8/12* (2013.01); *C21D 8/1272* (2013.01); *C22C 38/00* (2013.01); *C22C 38/001* (2013.01); *C22C 38/004* (2013.01); *C22C 38/02* (2013.01); *C22C 38/04* (2013.01); *C22C 38/06* (2013.01); *C22C 38/14* (2013.01); *H01F 1/16* (2013.01); *C21D 2201/05* (2013.01); *H01F 1/14775* (2013.01)

(58) Field of Classification Search

CPC ..... C21D 8/02; C21D 8/0273
USPC ..... 148/648, 651
See application file for complete search history.

(56) References Cited

U.S. PATENT DOCUMENTS

| | | | |
|---|---|---|---|
| 5,084,112 | A | 1/1992 | Tachino et al. |
| 7,922,834 | B2 | 4/2011 | Tanaka et al. |
| 2009/0202383 | A1 | 8/2009 | Tanaka et al. |
| 2011/0229362 | A1 | 9/2011 | Kubota |

FOREIGN PATENT DOCUMENTS

| | | | |
|---|---|---|---|
| CN | 101310034 | A | 11/2008 |
| JP | 2007186791 | A | 7/2007 |
| JP | 201031328 | A | 2/2010 |
| KR | 1020110097525 | A | 8/2011 |
| WO | 2006068399 | A1 | 6/2006 |
| WO | 2007069776 | A1 | 6/2007 |

OTHER PUBLICATIONS

Nakayama et al., Effects of titanium on magnetic properties of semi-processed non-oriented electrical steel sheets, Journal of Materials Science, 1997, pp. 1055-1059, vol. 32.

*Primary Examiner* — Brian Walck
(74) *Attorney, Agent, or Firm* — The Webb Law Firm

(57) ABSTRACT

A non-grain-oriented electrical steel strip or sheet consisting of a steel which contains, in addition to iron and unavoidable impurities, (in wt. %) Si: 1.0-4.5%, Al: up to 2.0%, Mn: up to 1.0%, C: up to 0.01%, N: up to 0.01%, S: up to 0.012%, Ti: 0.1-0.5% P: 0.1-0.3%, wherein 1.0≤% Ti/% P≤2.0 applies for the % Ti/% P ratio. The NGO sheet or strip can be manufactured by cold rolling a hot strip of a steel having the previously mentioned composition into a cold strip and subjecting this cold strip to a final annealing process. Different variants of this final annealing process may be used to accentuate the properties of the strip or sheet. The non-grain-oriented electrical steel strip or sheet and components manufactured from such a sheet or strip for electrotechnical applications are characterized by increased strength and good magnetic properties.

2 Claims, No Drawings

NON-GRAIN-ORIENTED ELECTRICAL STEEL STRIP OR SHEET, COMPONENT MANUFACTURED FROM IT AND METHOD FOR PRODUCING A NON-GRAIN-ORIENTED ELECTRICAL STEEL STRIP OR SHEET

CROSS-REFERENCE TO RELATED APPLICATIONS

This application is the United States national phase of International Application No. PCT/EP2012/075966 filed Dec. 18, 2012 and claims priority to European Patent Application No. 12150315.5 filed Jan. 5, 2012, the disclosures of which are hereby incorporated by reference in their entirety.

BACKGROUND OF THE INVENTION

Field of the Invention

The invention relates to a non-grain-oriented electrical steel strip or sheet for electrotechnical applications, to an electrotechnical component manufactured from such an electrical steel strip or sheet and to a method for producing an electrical steel strip or sheet.

Description of Related Art

Non-grain-oriented electrical steel strips or sheets, also referred to in the industry as "NGO electrical steel strips or sheets", are used to strengthen the magnetic flux in iron cores of rotating electrical machines. Such sheets are typically used for electric motors and generators.

In order to increase the efficiency of such machines, the highest rotational speeds or largest diameters possible are sought for the components respectively rotating in operation. As a result of this trend, the electrically relevant components manufactured from electrical steel strips or sheets of the type in question here are exposed to a high mechanical load which often cannot be met by the types of NGO electrical steel strip available today.

An NGO electrical steel strip or sheet is known from U.S. Pat. No. 5,084,112, which has a yield point of at least 60 kg-f/mm$^2$ (approx. 589 MPa) and is manufactured from a steel which, in addition to iron and unavoidable impurities, contains (in wt. %) up to 0.04% C, 2.0%—less than 4.0% Si, up to 2.0 Al, up to 0.2% P and at least one element from the group "Mn, Ni", wherein the total contents of Mn and Ni is at least 0.3% and at most 10%.

In order to obtain an increase in strength by the formation of carbon nitrides, the steel known from U.S. Pat. No. 5,084,112 contains at least one element from the group "Ti, V, Nb, Zr", wherein in the case of the presence of Ti or V the Ti content % Ti and the V content % V in relation to the C content % C and the respectively unavoidable N content % N of the steel should satisfy the condition $[0.4\times(\%\ Ti+\%\ V)]/[4\times(\%\ C+\%\ N)]<4.0$. A strength-increasing effect is also attributed to the presence of phosphorus in the steel. However, the presence of higher contents of phosphorus is advised against, since it can cause grain boundary brittleness. In order to counteract this problem, which is considered to be serious, an additional B content of 0.001-0.007% is proposed.

The steel composed in such a way is cast into slabs according to U.S. Pat. No. 5,084,112, which are subsequently hot rolled into a hot strip which is optionally annealed, then pickled and after that cold rolled into a cold strip having a specific final thickness. The cold strip obtained is subsequently subjected to a recrystallising annealing process, in which it is annealed at an annealing temperature which is at least 650° C. but less than 900° C.

In the case of the presence of effective contents of Ti and P and B, N, C, Mn and Ni in the steel at the same time, although the NGO electrical steel strips or sheets produced according to U.S. Pat. No. 5,084,112 achieve yield points of at least 70.4 kg-f/mm$^2$ (688 MPa), at the same time the hysteresis losses $P_{1.5}$ are at least 6.94 W/kg with a sheet thickness of 0.5 mm and at a polarisation of 1.5 Tesla and a frequency of 50 Hz. Such high hysteresis losses are no longer acceptable for modern electrotechnical applications. Furthermore, in the case of many such applications, the hysteresis losses are of great importance at higher frequencies.

SUMMARY OF THE INVENTION

Against this background, the object of the invention consisted in specifying an NGO electrical steel strip or sheet and a component for electrotechnical applications, which is manufactured from such a sheet or strip, which have increased strength, in particular a higher yield point, and, at the same time, have good magnetic properties, in particular a low hysteresis loss at high frequencies. In addition, a method for producing such an NGO electrical steel strip or sheet should be specified.

A non-grain-oriented electrical steel strip or sheet for electrotechnical applications, which is constituted according to the invention, is therefore manufactured from a steel which consists (in wt. %) of 1.0-4.5% Si, in particular 2.4-3.4% Si, up to 2.0% Al, in particular up to 1.5% Al, up to 1.0% Mn, up to 0.01% C, in particular up to 0.006%, particularly advantageously up to 0.005% C, up to 0.01% N, in particular up to 0.006% N, up to 0.012% S, in particular up to 0.006% S, 0.1-0.5% Ti, and 0.1-0.3% P and iron and unavoidable impurities as the remainder, wherein $$1.0\leq\%\ Ti/\%\ P\leq 2.0$$

applies for the % Ti/% P ratio of the Ti content % Ti to the P content % P.

The invention uses FeTi phosphides (FeTiP) to increase the strength. Thus, according to the invention, a silicon steel with Si contents of 1.0-4.5 wt. %, in a practice-oriented embodiment in particular of 2.4-3.4 wt. %, is alloyed with titanium and phosphorus, in order to form fine FeTiP precipitations and increase the strength of NGO electrical steel strip or sheet through particle hardening.

A particularly practice-oriented embodiment of the alloying according to the invention of an electrical steel strip or sheet then results if the contents of Si, C, N, S, Ti and P in the steel are in each case optionally limited (in wt. %) to 2.4-3.4% Si, up to 0.005% C, up to 0.006% N, up to 0.006% S, up to 0.5% Ti or up to 0.3% P. In the steel according to the invention, in addition up to 2.0% Al and up to 1.0% Mn can be present.

The invention uses FeTi phosphides to increase the strength instead of carbon nitrides which are usually used for this purpose. In this way, on the one hand, magnetic aging, which can occur as a result of high C and/or N contents, can be prevented. In addition to the simultaneous presence of a sufficient absolute amount of Ti and P respectively, it is at the same time essential that the ratio of the Ti content % Ti to the P content % P satisfies the condition specified in Claim 1, according to which the ratio of the titanium content to the phosphorus content of the electrical steel strip or sheet according to the invention is in each case greater than or equal to 1.0 and at the same time less than or equal to 2.0.

It is only by keeping to the narrow limits specified according to the invention on the contents of Ti and P and their contents ratio that the electrical steel sheet or strip composed according to the invention can have a sufficient number and sufficient distribution of FeTiP particles, so that alongside a sufficiently high strength good electromagnetic properties can also be guaranteed. By setting the ratio of % Ti to % P according to the invention, on the one hand, a damaging excess of phosphorus is prevented, which in the electrical steel strip or sheet according to the invention would lead to brittleness, and, on the other hand, an inordinate excess of titanium is also prevented by the ratio specified according to the invention. Such a Ti excess could lead to the formation of titanium nitrides which would have an adverse effect on the magnetic properties of the electrical steel strip or sheet.

The invention proceeds from the finding that the maximum effect utilised according to the invention of the simultaneous presence of Ti and P in a non-grain-oriented electrical steel sheet or strip according to the invention can be achieved if its contents of Ti and P, with deviations which are as low as possible, correspond to the stoichiometric ratio of 1.55. An embodiment of the invention, which takes this finding into account and at the same time is particularly important in practice, therefore makes provision for $$1.43 \leq \%\ Ti/\%\ P \leq 1.67$$

to apply for the % Ti/% P ratio of the Ti content % Ti to the P content % P.

The FeTiP particles made possible by the steel composition according to the invention consistently have a diameter which is much less than 0.1 μm. This takes into account the effect that although the strength of a material increases with the number of lattice imperfections, such as foreign atoms, dislocations, grain boundaries or particles of another phase, these lattice imperfections have an adverse effect on the magnetic characteristic values of a material. The adverse effect is, as is known per se, at its strongest when the particle size lies in the region of the Bloch wall thickness (transition region between magnetic domains with differing magnetisation), i.e. is about 0.1 μm. As considerably smaller particles are used according to the invention for increasing the strength, this adverse effect occurs at most in a markedly minimised form in an electrical steel sheet according to the invention. Occasional FeTiP particles which are distinctly greater than 0.1 μm can also be present in the material according to the invention. However, these affect the properties of a product according to the invention at most to a negligible extent.

With an alloy composed according to the invention, the microalloying elements usually alloyed to increase the strength by forming carbon nitrides, such as Nb, Zr or V, in conjunction with high contents of carbon or nitrogen are no longer required. Higher contents of C and N have a negative effect on the magnetic properties of the correspondingly composed non-grain-oriented electrical steel strip or sheet, since they involve an unwanted magnetic aging of the materials during practical use. Therefore, according to the invention, the increase in strength is achieved by particle hardening, namely by the presence of FeTiP precipitations, but not with the aid of carbon and/or nitrogen, the presence of which would lead to aging effects.

Correspondingly, electrical steel strips or sheets composed according to the invention consistently have hysteresis losses $P_{1.0/400}$ at a polarisation of 1.0 Tesla and a frequency of 400 Hz of at most 65 W/kg with a thickness of the electrical steel band or sheet of 0.5 mm and of at most 45 W/kg with a thickness of 0.35 mm. At the same time, they consistently achieve an increase in the yield point of at least 60 MPa compared to a conventionally composed alloy, which although it has no effective contents of Ti and P in other respects has contents of other alloying elements corresponding with an alloy according to the invention.

The method according to the invention is designed in such a way that it enables a non-grain-oriented electrical steel strip or sheet according to the invention to be reliably produced.

DESCRIPTION OF THE INVENTION

For this purpose, firstly a hot strip, which is composed in the way previously explained for the non-grain-oriented electrical steel sheet or strip according to the invention, is provided which is subsequently cold rolled and is subjected to a final annealing process as a cold-rolled strip. The finally annealed cold strip obtained after final annealing then represents the electrical steel strip or sheet composed and constituted according to the invention.

The hot strip provided according to the invention can to the greatest possible extent be manufactured conventionally. For this purpose, firstly a steel melt, having a composition corresponding to a specification according to the invention (Si: 1.0-4.5%, Al: up to 2.0%, Mn: up to 1.0%, C: up to 0.01%, N: up to 0.01%, S: up to 0.012%, Ti: 0.1-0.5% and P: 0.1-0.3%, with the remainder iron and unavoidable impurities, details in wt. %, wherein $1.0 \leq \%\ Ti/\%\ P \leq 2.0$ applies for the % Ti/% P ratio of the Ti content % Ti to the P content % P, can be melted and cast into a semi-finished product which in the case of conventional manufacture can be a slab or thin slab. Since the processes of precipitation formation according to the invention take place after the solidification, the steel melt can in principle, however, also be cast into a cast strip which is subsequently hot rolled into a hot strip.

The semi-finished product produced in such a way can then be brought to a semi-finished product temperature of 1020-1300° C. For this purpose, the semi-finished product is if necessary re-heated or by using the casting heat held at the respective target temperature.

The semi-finished product heated in such a way can then be hot rolled into a hot strip having a thickness which is typically 1.5-4 mm, in particular 2-3 mm. The hot rolling begins in a way which is known per se at a hot-rolling initial temperature of 1000-1150° C. and finishes at a hot-rolling final temperature of 700-920° C., in particular 780-850° C.

The hot strip obtained can subsequently be cooled down to a coiling temperature and coiled into a coil. The coiling temperature is ideally chosen in such a way that precipitation of the Fe—Ti phosphides is prevented, in order to prevent problems with the cold rolling which is subsequently carried out. In practice, the coiling temperature for this purpose is, for example, at most 700° C.

Optionally, the hot strip can be subjected to a hot-strip annealing process.

The hot strip provided is cold rolled into a cold strip having a thickness which is typically in the range of 0.15 mm-1.1 mm, in particular 0.2-0.65 mm.

The concluding final annealing process decisively contributes to the formation of the FeTiP particles used according to the invention for increasing strength. At the same time, by varying the annealing conditions of the final annealing process, it is possible to optionally optimise the material properties in favour of a higher strength or a lower hysteresis loss.

Non-grain-oriented electrical steel sheets or strips according to the invention, having yield points in the range of 390-550 MPa and hysteresis losses $P_{1.0/400}$ which with a strip thickness of 0.35 mm are less than 27 W/kg and with a strip thickness of 0.5 mm are less than 47 W/kg, can be particularly reliably obtained according to a first variant of the method according to the invention by passing the cold strip during final annealing through a two-stage short-term annealing process completed in the continuous annealing furnace, in which the cold strip in the first annealing stage d.1) is firstly annealed over an annealing period of 1-100 s at an annealing temperature of at least 900° C. and at most 1150° C. and then in a second annealing stage d.2) is annealed over an annealing period of 30-120 at an annealing temperature of 500-850° C. With this variant, the FeTiP precipitations which are possibly already present are dissolved in the first annealing stage d.1) and a full recrystallisation of the microstructure is brought about. In the second annealing stage d.2), the targeted precipitation of the FeTiP particles then takes place.

In order to bring about a further improvement in the strength level of the non-grain-oriented electrical steel sheet or strip obtained after the previously explained two-stage short-term annealing process, optionally a long-term annealing process carried out in the bell-type annealing furnace can follow the two-stage short-term annealing process, in which the cold strip is annealed at temperatures of 550-660° C. over an annealing period of 0.5-20 h. The increase in the yield point obtainable by this additional long-term annealing process is consistently at least 50 MPa.

Non-grain-oriented electrical steel sheets or strips having yield points of 500-800 MPa and hysteresis losses $P_{1.0/400}$ of less than 45 W/kg for 0.35 mm thick electrical steel sheets or strips can be produced according to a second variant of the method according to the invention by carrying out final annealing as a short-term annealing process, in which the cold strip is annealed in the continuous annealing furnace over an annealing period of 20-250 s at an annealing temperature of 750-900° C. In so doing, a full recrystallisation of the microstructure is not achieved due to the lower annealing temperature. However, the desired strength-increasing FeTiP precipitations are formed.

An alternative possibility for producing non-grain-oriented electrical steel sheets having yield points which lie in the range of 500-800 MPa and hysteresis losses $P_{1.0/400}$ of less than 45 W/kg for 0.35 mm thick electrical steel sheets or strips can be obtained according to a third variant of the method according to the invention by carrying out final annealing as a long-term annealing process in the bell-type annealing furnace, in which the cold strip is annealed over an annealing period lasting 0.5-20 h at an annealing temperature of 600-850° C. In this variant, a fully recrystallised microstructure does not occur. However, FeTiP precipitations are formed which are finer than the FeTiP precipitations which are present in the non-grain-oriented electrical steel sheets or strips produced according to the previously explained first variant. Improvements in the hysteresis losses compared to the previously explained second variant can be brought about by means of the third variant of the method according to the invention explained here.

Optionally, with the third variant of the method according to the invention, another short-term annealing process can also be carried out in the continuous annealing furnace after the long-term annealing process, in which the respective cold strip is annealed at 750-900° C. over an annealing period of 20-250 s. The degree of recrystallisation can be improved by this additional short-term annealing process. As a consequence thereof, an improvement in the hysteresis loss can be expected.

In order to introduce a critical energy by increasing the dislocation density, so that recrystallisation is initiated in the subsequent short-term annealing process, the cold strip can optionally be subjected to a forming operation with a degree of deformation of at least 0.5% and at most 12% in the course of the third variant of the method according to the invention between the long-term annealing process and the short-term annealing process. Such a forming step, which is usually carried out as an additional cold-rolling step, moreover contributes to improving the flatness of the non-grain-oriented electrical steel sheet or strip obtained on completion of this variant of the method according to the invention. The effects obtained with the cold forming optionally additionally carried out can be particularly reliably achieved if the degrees of deformation of the cold forming are 1-8%.

A planishing pass carried out in a conventional manner can be added to the final annealing process.

In addition, the non-grain-oriented electrical steel strip or sheet material obtained can finally be subjected to a conventional stress-relief annealing process. Depending on the processing sequences at the place of final processing, this stress-relief annealing process can still be carried out in the coil at the place of manufacture of the NGO electrical steel strip or sheet or firstly the blanks processed at the place of final processing can be separated from the electrical steel strip or sheet produced according to the invention and then subjected to the stress-relief annealing process.

The invention is explained in more detail below by exemplary embodiments.

The tests explained below were each carried out under laboratory conditions. Firstly, a steel melt TiP composed according to the invention and a reference melt Ref are melted and cast into slabs. The compositions of the melt TiP and Ref are specified in Table 1. In the case of the reference melt, with the exception of the effective contents of Ti and P which are not present in it, not only the alloying elements but also their contents, within the limits of the usual tolerances, correspond with the melt TiP according to the invention.

The slabs were brought to a temperature of 1250° C. and hot rolled into a 2 mm thick hot strip at a hot-rolling initial temperature of 1020° C. and a hot-rolling final temperature of 840° C. The respective hot strip was cooled down to a coiling temperature $T_{coil}$. Afterwards, typical cooling was simulated in the coil.

Three samples of the hot strips consisting of the steel alloy TiP according to the invention and one sample of the hot strips consisting of the reference steel Ref were subsequently subjected to a hot-strip annealing process over a period of 2 h at a temperature of 740° C. and after that were cold rolled into a cold strip having a final thickness of 0.5 mm or 0.35 mm.

In contrast, two further samples of the hot strips consisting of the steel alloy TiP according to the invention and a further sample of the hot strips consisting of the reference steel Ref were in each case cold rolled into a 0.5 mm thick cold strip with no annealing.

Subsequently, in each case a two-stage final annealing process was carried out. In the first annealing stage, the samples were heated to 1100° C. and held at this temperature for 15 s, so that the Ti and P contained in them were mostly dissolved. The second annealing stage followed this, in which annealing was carried out at a temperature $T_{low}$ which was distinctly below the precipitation temperature $T_{prec}$ of FeTiP. In this way, the desired fine, on average 0.01-0.1 μm sized FeTi phosphide precipitations were formed.

The coiling temperature $T_{coil}$ and the temperature $T_{low}$ are in each case specified for the samples cold rolled to a thickness of 0.5 mm in Table 2 and for the samples cold rolled to a thickness of 0.35 mm in Table 3. Additionally, in Tables 2 and 3, in each case measured in the transverse and longitudinal directions of the sample, for each of the samples the upper yield point $R_{eH}$, the lower yield point $R_{eL}$, the tensile strength $R_m$, the hysteresis losses $P_{1.0}$ (hysteresis loss at a polarisation of 1.0 T), $P_{1.5}$ (hysteresis loss at a polarisation of 1.5 T) and the polarisations $J_{2500}$ (polarisation at a magnetic field strength of 2500 A/m) and $J_{5000}$ (polarisation at a magnetic field strength of 5000 A/m), in which each of the hysteresis losses and polarisations mentioned above are determined at 50 Hz, as well as the hysteresis losses $P_{1.0}$ (hysteresis loss at a polarisation of 1.0 T) determined at a frequency of 400 Hz and 1 kHz respectively, are specified.

It has become apparent that the lower yield point $R_{eL}$ is in each case higher by 60-100 MPa in the case of the samples composed and processed according to the invention compared to the samples produced from the reference steel Ref. In contrast, there is no significant difference between the samples produced with and without a hot-strip annealing process. A variation in the coiling temperature or the temperature $T_{low}$ also has no significant effect on the mechanical properties.

At a frequency of 50 Hz, the samples produced from the steel according to the invention, with 3.9-4.8 W/kg for 0.5 mm thick sheets and with less than 3.7 W/kg for 0.35 mm thick sheets, have slightly higher hysteresis losses $P_{1.5}$ than the samples produced from the reference steel. The coiling temperature also has no significant effect here.

In contrast, at higher frequencies of 400 Hz and 1 kHz, the hysteresis losses $P_{1.0}$ for the samples according to the invention and the reference samples are very close to one another. Here, the samples with the higher temperature $T_{low}$ of 700° C. exhibit, in the case of the 0.5 mm thick sheets with less than 39 W/kg at 400 Hz and with less than 180 W/kg at 1 kHz, fewer hysteresis losses $P_{1.0}$ than the reference material. In the case of the 0.35 mm thick sheets, in each case the same hysteresis losses were obtained as with the reference material.

In a further series of tests, a steel TiP2 is melted and cast into slabs, the composition of which is specified in Table 4. In the case of the steel TiP2, the % Ti/% P ratio of the Ti content % Ti to the P content % P is % Ti/% P=1.51.

The slabs are re-heated to 1250° C. and subsequently hot rolled into hot strips having a hot strip thickness of 2.1 mm or 2.4 mm. The hot-rolling initial temperature was in each case 1020° C., while the hot-rolling final temperature was in each case 840° C. The hot strips obtained were then coiled at a coiling temperature of 620° C.

Subsequently, the hot strips obtained in such a way without previous hot-strip annealing were cold rolled into 0.35 mm thick cold strip.

Samples of the cold strips obtained in such a way were subjected to different variants of final annealing processes.

In the first variant, a two-stage short-term annealing process is completed in the continuous annealing furnace. In the first stage of the short-term annealing process, in each case the annealing times $t_{G1}$ specified in Table 5 were adhered to and the respective maximum annealing temperatures $T_{max1}$ also given there were reached, while the second stage was in each case completed in the annealing times $t_{G2}$ likewise specified in Table 5 with the maximum annealing temperatures $T_{max2}$ also given there. The mechanical and magnetic properties determined in the transverse direction Q and longitudinal direction L on the finally annealed NGO electrical steel sheet samples obtained in such a way are likewise recorded in Table 5.

One sample of the samples finally annealed according to the first variant was subsequently subjected to an additional long-term annealing process in a bell-type annealing furnace. The annealing times $t_{GH}$ adhered to in the process and maximum annealing temperatures $T_{maxH}$ are specified in Table 6. The mechanical and magnetic properties determined in the transverse direction Q and longitudinal direction L on the additionally long-term annealed NGO electrical steel sheet obtained in such a way are likewise recorded in Table 6. It has become apparent that a distinct increase in the yield point $R_e$ and the tensile strength $R_m$ could be achieved by the supplementary long-term annealing process, while the magnetic properties did not significantly deteriorate.

In a second variant of the final annealing process, samples of the cold strips are subjected to a long-term annealing process at different temperatures $T_{maxH}$ in the bell-type annealing furnace over an annealing period $t_{GH}$. The temperatures $T_{maxH}$ mentioned and the respective annealing period $t_{GH}$ are listed in Table 7. The mechanical and magnetic properties determined in the transverse direction Q and longitudinal direction L on the long-term annealed NGO electrical steel sheet samples obtained in such a way are likewise recorded in Table 7.

In a third variant of the final annealing process, samples of the cold strips are subjected to a one-stage short-term annealing process at different temperatures $T_{maxD}$ in the continuous annealing furnace over an annealing period $t_{GD}$. The temperatures $T_{maxD}$ mentioned and the respective annealing period $t_{GD}$ are listed in Table 8. The mechanical and magnetic properties determined in the transverse direction Q and longitudinal direction L on the one-stage short-term annealed NGO electrical steel sheet samples obtained in such a way are in addition recorded in Table 8.

Thus, the invention relates to a non-grain-oriented electrical steel strip or sheet consisting of a steel which contains, in addition to iron and unavoidable impurities, (in wt. %) Si: 1.0-4.5%, Al: up to 2.0%, Mn: up to 1.0%, C: up to 0.01%, N: up to 0.01%, S: up to 0.012%, Ti: 0.1-0.5%, P: 0.1-0.3%, wherein 1.0≤% Ti/% P≤2.0 applies for the % Ti/% P ratio of the Ti content % Ti to the P content % P. A non-grain-oriented electrical steel strip or sheet according to the invention and components manufactured from such a sheet or strip for electrotechnical applications are characterised by increased strength and, at the same time, by good magnetic properties. The NGO sheet or strip according to the invention can be manufactured by cold rolling a hot strip, consisting of a steel having the previously mentioned composition, into a cold strip and subjecting this cold strip to a final annealing process. In order to particularly accentuate certain properties of the NGO strip or sheet, the invention provides different variants of this final annealing process.

TABLE 1

| Variant | Si | Al | Mn | C | N | S | Ti | P |
|---|---|---|---|---|---|---|---|---|
| TiP | 2.99 | 0.004 | 0.58 | 0.006 | 0.0021 | <0.001 | 0.148 | 0.100 |
| Ref | 2.96 | 0.006 | 0.64 | 0.006 | 0.0021 | 0.001 | 0.001 | 0.004 |

Remainder iron and unavoidable impurities, details in wt. %

TABLE 2

(Sheet thickness 0.5 mm)

| Steel | According to the invention? | Hot-strip annealing? | Sample direction | $T_{coil}$ [° C.] | $T_{low}$ [° C.] | $R_{eH}$ [MPa] | $R_{eL}$ [MPa] | $R_m$ [MPa] | 50 Hz $P_{1.0}$ [W/kg] | 50 Hz $P_{1.5}$ [W/kg] | 50 Hz $J_{2500}$ [T] | 50 Hz $J_{5000}$ [T] | 400 Hz $P_{1.0}$ [W/kg] | 1 kHz $P_{1.5}$ [W/kg] |
|---|---|---|---|---|---|---|---|---|---|---|---|---|---|---|
| TiP | YES | YES | L | 310 | 550 | 409 | 403 | 573 | 2.01 | 4.47 | 1.59 | 1.68 | 44.4 | 197 |
| | | | T | | | 430 | 426 | 593 | 2.20 | 4.76 | 1.57 | 1.66 | 46.8 | 213 |
| | | YES | L | 620 | 550 | 403 | 396 | 560 | 2.08 | 4.43 | 1.57 | 1.67 | 43.3 | 199 |
| | | | T | | | 421 | 418 | 582 | 1.97 | 4.44 | 1.55 | 1.65 | 40.3 | 181 |
| | | YES | L | 620 | 700 | 400 | 395 | 554 | 1.76 | 3.93 | 1.58 | 1.67 | 36.4 | 164 |
| | | | T | | | 431 | 424 | 589 | 1.86 | 4.17 | 1.55 | 1.64 | 38.9 | 178 |
| Ref | NO | YES | L | 620 | — | 329 | 321 | 472 | 1.72 | 3.78 | 1.61 | 1.70 | 43.9 | 205 |
| | | | T | | | 351 | 340 | 492 | 1.63 | 3.88 | 1.53 | 1.63 | 43.4 | 207 |
| TiP | YES | NO | L | 310 | 550 | 407 | 402 | 572 | 2.16 | 4.50 | 1.57 | 1.66 | 45.1 | 209 |
| | | | T | | | 433 | 429 | 591 | 1.98 | 4.59 | 1.54 | 1.64 | 40.2 | 181 |
| | | NO | L | 620 | 550 | 402 | 396 | 564 | 2.23 | 4.65 | 1.57 | 1.66 | 46.4 | 214 |
| | | | T | | | 426 | 423 | 586 | 2.19 | 4.77 | 1.53 | 1.63 | 46.2 | 214 |
| Ref | NO | NO | L | 620 | — | 365 | 339 | 480 | 1.47 | 3.34 | 1.63 | 1.71 | 38.0 | 173 |
| | | | T | | | 332 | 362 | 500 | 1.55 | 3.68 | 1.53 | 1.63 | 40.4 | 191 |

TABLE 3

(Sheet thickness 0.35 mm)

| Steel | According to the invention? | Hot-strip annealing? | Sample direction | $T_{coil}$ [° C.] | $T_{low}$ [° C.] | $R_{eH}$ [MPa] | $R_{eL}$ [MPa] | $R_m$ [MPa] | 50 Hz $P_{1.0}$ [W/kg] | 50 Hz $P_{1.5}$ [W/kg] | 50 Hz $J_{2500}$ [T] | 50 Hz $J_{5000}$ [T] | 400 Hz $P_{1.0}$ [W/kg] | 1 kHz $P_{1.5}$ [W/kg] |
|---|---|---|---|---|---|---|---|---|---|---|---|---|---|---|
| TiP | YES | NO | L | 620 | 700 | 430 | 415 | 579 | 1.77 | 3.74 | 1.55 | 1.65 | 26.4 | 112 |
| | | | T | | | 456 | 442 | 603 | 1.62 | 3.71 | 1.52 | 1.62 | 23.0 | 94 |
| Ref | NO | NO | L | 620 | — | 350 | 331 | 466 | 1.26 | 3.06 | 1.57 | 1.66 | 23.6 | 100 |
| | | | T | | | 359 | 344 | 453 | 1.28 | 3.22 | 1.54 | 1.63 | 23.2 | 99 |

TABLE 4

| Variant | Si | Al | Mn | C | N | S | Ti | P |
|---|---|---|---|---|---|---|---|---|
| TiP2 | 3.05 | 0.689 | 0.155 | 0.0036 | 0.0021 | 0.0008 | 0.173 | 0.115 |

Remainder iron and unavoidable impurities, details in wt. %

TABLE 5

(Sheet thickness 0.35 mm-Short-term annealing process-Variant 1)

| $T_{max1}$ [° C.] | $t_{G1}$ [s] | $T_{max2}$ [° C.] | $t_{G2}$ [s] | Sample direction | $R_{eH}$ [MPa] | $R_{el}$ or $R_{p0.2}$ [MPa] | Rm [MPa] | 50 Hz $P_{1.0}$ [W/kg] | 50 Hz $P_{1.5}$ [W/kg] | 50 Hz $J_{2500}$ [T] | 50 Hz $J_{5000}$ [T] | 400 Hz $P_{1.0}$ [W/kg] | 1 kHz $P_{1.0}$ [W/kg] |
|---|---|---|---|---|---|---|---|---|---|---|---|---|---|
| 1070 | 55 | 700 | 50 | L | 448 | 442 | 608 | 1.60 | 3.9 | 1.54 | 1.63 | 20.5 | 79 |
| | | | | T | 474 | 471 | 636 | 2.24 | 4.81 | 1.49 | 1.58 | 25.3 | 92 |
| 1100 | 40 | 700 | 50 | L | | 439 | 582 | 1.25 | 3.13 | 1.54 | 1.63 | 18.5 | 76 |
| | | | | T | | 468 | 600 | 1.77 | 3.87 | 1.48 | 1.58 | 22.9 | 88 |

TABLE 6

(Sheet thickness 0.35 mm-Short-term annealing process with subsequent long-term annealing process)

| $T_{maxH}$ [° C.] | $t_{GH}$ [h] | Sample direction | $R_{eH}$ [MPa] | $R_{el}$ or $R_{p0.2}$ [MPa] | Rm [MPa] | 50 Hz $P_{1.0}$ [W/kg] | 50 Hz $P_{1.5}$ [W/kg] | 50 Hz $J_{2500}$ [T] | 50 Hz $J_{5000}$ [T] | 400 Hz $P_{1.0}$ [W/kg] | 1 kHz $P_{1.0}$ [W/kg] |
|---|---|---|---|---|---|---|---|---|---|---|---|
| 620 | 5 | L | 484 | 478 | 640 | 1.68 | 4.03 | 1.55 | 1.65 | 22.2 | 86 |
| | | T | 513 | 511 | 654 | 2.24 | 4.91 | 1.5 | 1.6 | 26.6 | 99 |

TABLE 7

(Sheet thickness 0.35 mm-Long-term annealing process-Variant 2)

| | | | | | | 50 Hz | | | | 400 Hz | 1 kHz |
|---|---|---|---|---|---|---|---|---|---|---|---|
| $T_{maxH}$ [° C.] | $t_{GH}$ [h] | Sample direction | $R_{eH}$ [MPa] | $R_{el}$ or $R_{p0.2}$ [MPa] | Rm [MPa] | $P_{1.0}$ [W/kg] | $P_{1.5}$ [W/kg] | $J_{2500}$ [T] | $J_{5000}$ [T] | $P_{1.0}$ [W/kg] | $P_{1.0}$ [W/kg] |
| 620 | 5 | L | 753 | 724 | 866 | 3.83 | 8.4 | 1.52 | 1.62 | 39.1 | 128 |
| | | T | 814 | 801 | 919 | 4.35 | 9.45 | 1.44 | 1.55 | 43.6 | — |
| 700 | 5 | L | 666 | 615 | 781 | 3.43 | 7.62 | 1.54 | 1.63 | 36.6 | 121 |
| | | T | 705 | 668 | 823 | 3.87 | 8.51 | 1.45 | 1.55 | 39.3 | 131 |
| 740 | 5 | L | 614 | 567 | 739 | 3.39 | 7.63 | 1.54 | 1.64 | 36.2 | 123 |
| | | T | 657 | 609 | 777 | 3.86 | 8.65 | 1.47 | 1.58 | 40 | 136 |
| 840 | 5 | L | 560 | 524 | 686 | 3.62 | 7.96 | 1.55 | 1.65 | 38.5 | 128 |
| | | T | 602 | 560 | 712 | 3.97 | 8.61 | 1.5 | 1.6 | 42.0 | — |

TABLE 8

(Sheet thickness 0.35 mm-Short-term annealing process-Variant 3)

| | | | | | | 50 Hz | | | | 400 Hz | 1 kHz |
|---|---|---|---|---|---|---|---|---|---|---|---|
| $T_{maxD}$ [° C.] | $t_{GD}$ [s] | Sample direction | $R_{eH}$ [MPa] | $R_{el}$ or $R_{p0.2}$ [MPa] | Rm [MPa] | $P_{1,0}$ [W/kg] | $P_{1,5}$ [W/kg] | $J_{2500}$ [T] | $J_{5000}$ [T] | $P_{1.0}$ [W/kg] | $P_{1.0}$ [W/kg] |
| 900 | 60 | L | 585 | 541 | 713 | 4.06 | 8.62 | 1.54 | 1.63 | 42.1 | 143 |
| | | T | 627 | 589 | 770 | 4.38 | 9.36 | 1.47 | 1.57 | 43.8 | 145 |
| 800 | 80 | L | 630 | 606 | 790 | 4.06 | 8.69 | 1.52 | 1.61 | 41.7 | 140 |
| | | T | 672 | 667 | 843 | 4.39 | 9.5 | 1.45 | 1.55 | 43.8 | 142 |
| 700 | 150 | L | — | 735 | 878 | 4.5 | 9.68 | 1.51 | 1.61 | 44.9 | 145 |
| | | T | — | 832 | 926 | 5.09 | 10.98 | 1.43 | 1.54 | 48.7 | 154 |

The invention claimed is:

1. A method for producing a non-grain-oriented electrical steel strip or sheet, in which the following production steps are carried out:

a) providing a hot strip which consists of a steel comprising, in addition to iron and unavoidable impurities, (in wt. %)

Si: 1.0-4.5%,
Al: up to 2.0%,
Mn: up to 1.0%,
C: up to 0.01%,
N: up to 0.01%,
S: up to 0.012%,
Ti: 0.1-0.5%,
P: 0.1-0.3%,
wherein 1.0≤% Ti/% P≤2.0
applies for the % Ti/% P ratio of the Ti content % Ti to the P content % P;

b) cold rolling the hot strip into a cold strip and c) final annealing the cold strip, wherein during final annealing the cold strip passes through a short-term annealing process performed in a single pass through a single continuous annealing furnace, comprising 1) firstly annealing the cold strip in a first annealing stage over an annealing period of 1-100 seconds at an annealing temperature of at least 900° C. and at most 1150° C., and then 2) annealing the cold strip in a second annealing stage over an annealing period of 30-120 seconds at an annealing temperature of 500-850° C.

2. The method according to claim 1, wherein the cold strip is subjected to a long-term annealing process extending over an annealing period of 0.5-20 hours at an annealing temperature of 550-660° C. in a bell-type annealing furnace after the second annealing stage of the short-term annealing process.

* * * * *